US010995588B2

(12) United States Patent
Damour et al.

(10) Patent No.: US 10,995,588 B2
(45) Date of Patent: May 4, 2021

(54) INSTALLATION OF HEATING FOR HYDROCARBON EXTRACTION PIPES

(71) Applicant: ITP SA, Louveciennes (FR)

(72) Inventors: Jean-Aurélien Damour, Louveciennes (FR); Guillaume Coeffe, Louveciennes (FR); Darren Johannson, Louveciennes (FR)

(73) Assignee: ITP SA, Louveciennes (FR)

( * ) Notice: Subject to any disclaimer, the term of this patent is extended or adjusted under 35 U.S.C. 154(b) by 0 days.

(21) Appl. No.: 16/618,223

(22) PCT Filed: May 28, 2018

(86) PCT No.: PCT/FR2018/000144
§ 371 (c)(1),
(2) Date: Nov. 29, 2019

(87) PCT Pub. No.: WO2018/220293
PCT Pub. Date: Dec. 6, 2018

(65) Prior Publication Data

US 2020/0115994 A1 Apr. 16, 2020

(30) Foreign Application Priority Data

May 29, 2017 (FR) ..... 1770549

(51) Int. Cl.
*E21B 36/00* (2006.01)
*E21B 36/04* (2006.01)
*E21B 43/24* (2006.01)

(52) U.S. Cl.
CPC ..... *E21B 36/006* (2013.01); *E21B 36/003* (2013.01); *E21B 36/04* (2013.01); *E21B 43/2401* (2013.01); *E21B 43/2406* (2013.01)

(58) Field of Classification Search
CPC ..... E21B 36/006; E21B 36/003; E21B 36/04; E21B 43/2401; E21B 43/24; E21B 36/00
See application file for complete search history.

(56) References Cited

U.S. PATENT DOCUMENTS 3,215,197 A * 11/1965 Kiel ..... E21B 43/16 166/268
3,493,050 A 2/1970 Kelley et al.
(Continued)

FOREIGN PATENT DOCUMENTS

FR 2 746 891 A1 10/1997
FR 2 862 122 A1 5/2005

OTHER PUBLICATIONS

Sep. 7, 2018 Search Report issued in International Patent Application No. PCT/FR2018/000144.
(Continued)

*Primary Examiner* — Tara Schimpf
*Assistant Examiner* — Manuel C Portocarrero
(74) *Attorney, Agent, or Firm* — Oliff PLC

(57) ABSTRACT

A heating installation for hydrocarbon extraction pipes via a well linking the surface to an extraction zone, including a substantially cylindrical casing consolidating the drill hole, a hydrocarbon extraction method and method to enable a hot fluid to be made to circulate from the surface to the well zone to be heated. The injection method includes in the casing first thermally insulated heating tubing to inject the hot fluid from the surface to the required depth and second heating tubing surrounding the first tubing to bring the hot fluid towards the surface and the extraction method includes a pumping tubing surrounding the first and second heating tubing for the extraction of hydrocarbons.

10 Claims, 2 Drawing Sheets

(56) References Cited

U.S. PATENT DOCUMENTS

Figure 1:
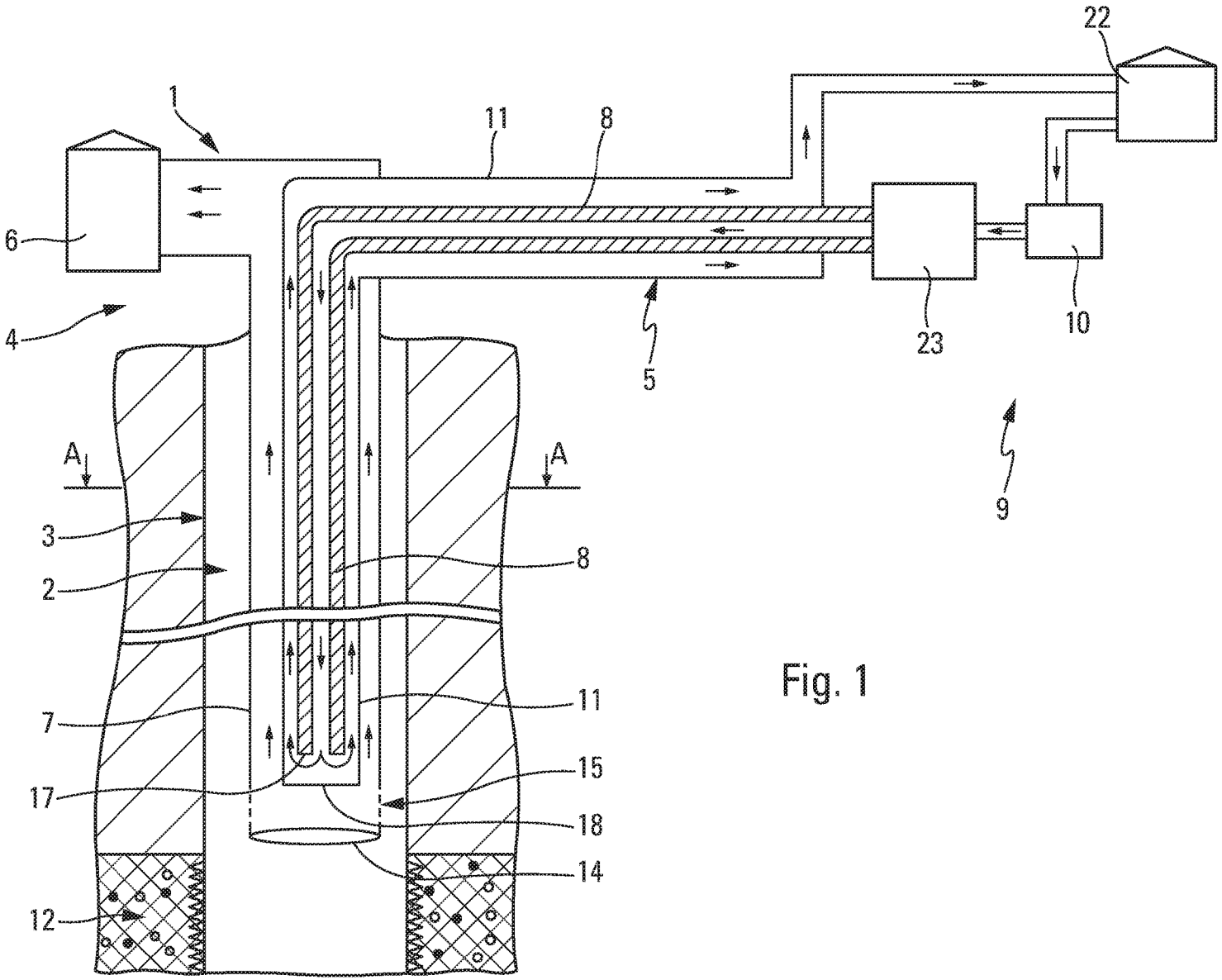

| | | | | |
|---|---|---|---|---|
| 4,022,280 | A | 5/1977 | Stoddard et al. | |
| 4,477,106 | A * | 10/1984 | Hutchison | E21B 17/00 138/149 |
| 4,671,351 | A | 6/1987 | Rappe | |
| 8,955,591 | B1 | 2/2015 | Hytken | |
| 2002/0195256 | A1* | 12/2002 | Metcalfe | E21B 33/10 166/387 |
| 2005/0072567 | A1 | 4/2005 | Steele et al. | |

OTHER PUBLICATIONS

Jan. 15, 2018 Search Report issued in French Patent Application No. 1770549.

* cited by examiner

INSTALLATION OF HEATING FOR HYDROCARBON EXTRACTION PIPES

The technical scope of the present invention is that of devices for heating hydrocarbon extraction tubing in a paraffinic or heavy crude oil well.

It is known to date to extract liquids from the ground, for example hydrocarbons, found in underground reservoirs that may be several kilometres under the ground. After drilling a hole from the surface to the reservoir where the liquid to be extracted is found, this hole is consolidated as it is being drilled by means of tubing of decreasing diameter. All this tubing constitutes a casing.

In the productive zone, towards the buried end, this casing is perforated with a certain number of openings so as to provide access for the liquid. This perforated part is called a screen or drain, depending on its length. Tubing of constant diameter less than that of the casing is introduced into the previous casing so as to reach the bottom of the drill hole to pump the liquid to the surface. This tubing is thus pumping tubing. This tubing may be equipped with a well-bottom pump.

One problem frequently encountered with certain oils lies in the deposits of paraffins or asphaltenes that form on the walls of the crude oil riser tubing in the wells. These fractions have a tendency to solidify, all the more so in that the temperature is low. These fractions tend to be deposited in the oil riser tubing as mentioned above and gradually block this tubing. It is then necessary, in order to continue extracting, to carry out a mechanical scraping operation so as to eliminate the paraffin that has built up in the tubing, therefore requiring production to be shut down.

Depending on the well, these production shutdowns must be made at a frequency ranging from once a week to several times a day for the most critical wells. These shutdowns lead to an overall reduction in production of the oil well.

Another problem encountered in the case of heavy oils is that of the loss of charge when the temperature of the oil drops in the riser tubing at the surface. This can cause a reduction in the flow rate of the well production or the necessity of selecting a more powerful pump.

It is thus observed that the high viscosity and solid deposits lead to slowing of the production flow rate, thereby increasing the cost of production per volume unit, which may lead to the closure of a well.

To solve this problem, a solution by heat supply consists in arranging resistive or inductive heating elements along the length of the oil riser tubing. These elements may be installed either outside or inside the tubing. In the case of an outside installation, the electrical elements need to be installed against the wall of the tubing to promote the thermal exchange between the resistances and the tubing. The risk lies in having a high temperature in these resistances. This raises the problem of the choice of materials for these resistances as well as for the connections.

Lastly, for reasons of reliability, it is difficult to supply great quantities of electrical energy to the bottom of a well.

The aim of the present invention is to supply a heating system for the oil riser tubing in a well to prevent paraffin or asphaltene deposits on the wall of the tubing during production, to dissolve these deposits that may have already appeared in the oil riser tubing during the shutdown and before the restarting of the well or to maintain the viscosity of the oil at an acceptable level for the pump at the well bottom.

The invention thus relates to a heating installation for hydrocarbon extraction pipes via a well linking the surface to an extraction zone, comprising a substantially cylindrical casing consolidating said drill hole, a hydrocarbon extraction means and means to enable a hot fluid to be made to circulate from the surface to the well zone to be heated, wherein the circulation means comprise in the casing a first thermally insulated heating tubing to inject the hot fluid from the surface to the required depth and a second heating tubing surrounding the first tubing to bring the hot fluid towards the surface, and where in the extraction means comprise a pumping tubing surrounding the first and second heating tubing for the extraction of hydrocarbons.

According to one characteristic of the invention, the first and second heating tubing are connected on the surface to a hot fluid production unit composed of a storage tank or an expansion tank, a pump and a heater to ensure a continuous circulation of the hot fluid in said heating tubing with a continuous monitoring of the temperature and flow rate.

The hot fluid leaving the heater circulates in the thermally insulated tubing up to the extremity of the latter and then returns to the surface between the thermally insulated tubing and the second heating tubing.

The expansion tank allows the increase in volume of the hot oil to be accommodated in the closed circuit and thereby limits any overpressure in the circuit.

According to yet another characteristic of the invention, the first heating tubing is open at its distal end and the second heating tubing is closed at its distal end by a transversal wall.

Advantageously, the first heating tubing is thermally insulated using a compression-resistant insulating, either because of its compressive strength properties or because of the addition of spacers positioned evenly between the first and second tubing.

According to yet another characteristic of the invention, the pumping tubing is connected to a surface extraction unit.

Advantageously, the pumping tubing is equipped with a well-bottom pump.

Advantageously again, the pumping tubing is open at its distal end and incorporates perforations at least at its terminal part.

According to yet another characteristic of the invention, the first heating tubing is constituted by a first inner pipe surrounded by a second concentric outer pipe and by an insulation housed in the space between the two pipes.

Advantageously, the insulation is constituted by a microporous material and a reduced pressure is established in the space between the two pipes.

Yet more specifically, the reduced pressure between the two pipes of the first tubing is of between 1 and 100 mbar.

According to yet another characteristic of the invention, the first heating tubing is fitted with an electric heating wire arranged against the inner wall of the inner pipe.

One advantage of the invention lies in the realisation of a closed circuit enabling the heat to be supplied in the pumping tubing, up to its extremity in the well, before the well-bottom pump. The hot fluid may be chosen from among the fluids used in heating installations, for example, an industrial thermal oil or water.

The hot fluid leaving the heater circulates in the first thermally insulated tubing until reaching the extremity of the latter, then returns to the surface between the first thermally insulated tubing and the second heating tubing. During this rise, the calorific energy contained in the hot fluid is dissipated by conducto-convection in the oil produced in the pumping tubing and in the pumping tubing itself.

The temperature of the hot fluid is at its maximal at the surface as it leaves the heater. The thermal losses, and thus the reduction in temperature of the fluid, are low during its descent in the thermally insulated tubing. When the hot fluid rises to the surface, the thermal exchanges with the pumping tubing are important to enable the heat exchange and so the temperature of the fluid drops considerably.

Thus, heat is applied to the pumping tubing and the crude oil produced in this tubing will maintain the temperature of the oil as it rises to the surface and prevent the appearance of paraffins or asphaltenes in the pumping tubing. The temperature at which the paraffin appears may be of between 25° C. and 70° C. depending on the hydrocarbon.

The closer the temperature of the reservoir to the temperature at which the paraffin appears, the higher the risk of paraffin deposits on the walls of the pumping tubing. Certain reservoirs have a temperature of only a few degrees Celsius above the temperature at which paraffin appears. In these cases, the petrol in the pumping tubing close to the bottom extremity of this tubing needs to be heated.

In the case of so-called heavy oil, maintaining its temperature enables the viscosity of the oil to be kept at the same level as in the formation at the well bottom thereby limiting the loss of head in the pumping tubing.

Another advantage of the invention lies in the control of the heat supplied to the pumping tubing section to be heated, so as to maintain the temperature of the oil produced whilst ensuring the continuity of production. The flow rate and the temperature of the hot fluid are controlled at the surface and may vary according to the minimum acceptable temperature for the oil in the pumping tubing.

Another advantage of the invention lies in the fact that there is no mixture of the hot fluid and the recovered hydrocarbons thereby enabling the elimination of a hydrocarbon separation unit.

Another advantage of the invention lies in the absence of pollution of the reservoir since the hot fluid does not contaminate this reservoir.

Another advantage of the invention lies in the use of an industrial thermal oil by way of a heat-transfer fluid. The volume of oil required in the closed loop formed by the first and second tubing is of between 500 litres and 3,000 litres. Such a thermal oil, standard in industry, will have an optimised composition to be heated at the required temperature, typically 80° C. and up to 200° C. and will enable surface equipment, pumps and heaters to be used that are standard in industry and therefore less complex.

Indeed, heating a mixture of hydrocarbons to temperatures of around 200° C. risks the creation of solid deposits on the heating elements of the boiler that could lead to a reduction in the heating power or even an increase in the temperature of the heating element concerned and its deterioration. The heating process for a thermal oil will be simpler since its composition is uniform and it will be selected so as to avoid the creation of deposits at the desired temperature.

Yet another advantage of the invention lies in the use of a fluid, even polluting. The installation according to the invention enables a control and adjustment at the surface of the temperature of the hot fluid according to the need for heating in the pumping tubing. Thus, any accumulation of paraffin in the tubing at its vertical and/or horizontal parts is prevented or eliminated.

Another advantage of the invention is that after a modification of the wellhead, this installation is independent from the other standard well production equipment and may thus be installed and removed according to the needs of the well whilst leaving in place this standard well-bottom and surface production equipment.

Another advantage of the invention lies in the fact that the tubing enabling the circulation in a closed loop of the hot fluid may be made using tubing that is wound and known as "coiled tubing". Double walled thermally insulated tubing can be produced using two tubing coiled and inserted into the second tubing of larger diameter, which may also be coiled tubing. This triple tubing may be coiled around a wheel for transport purposes and installed in the well in a single operation by a "coiled tubing" unit. Specific parts are installed at each extremity of the coiled tubing to isolate or join the annulus as required by the closed loop circulation.

Figure 2:
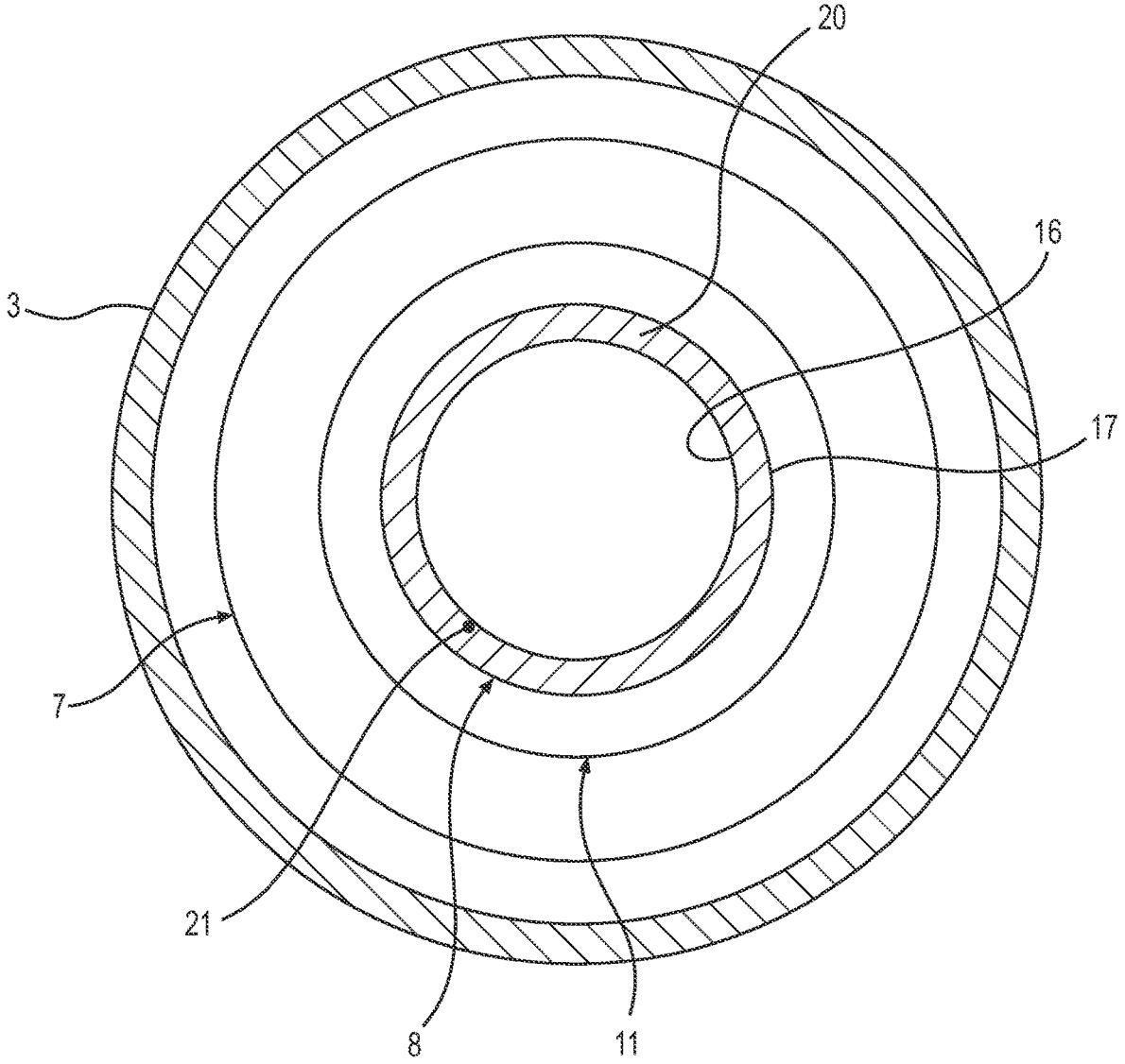

Other characteristics, particulars and advantages of the invention will become more apparent from the detailed description given hereafter by way of illustration and with reference to the drawings, in which:

FIG. 1 shows a hydrocarbon extraction tubing heating installation according to the invention, on a well, and FIG. 2 is a section view along AA in FIG. 1.

An oil well is generally constituted by two essential parts, an external envelope, called casing, intended to consolidate the inner wall of the well in the ground and an inner pipe, called tubing, enabling the oil to be brought up to the surface.

The invention will now be described in greater detail, noting that FIG. 1 illustrates all the vertical part of the drilling well.

FIG. 1 shows a substantially vertical crude oil extraction well incorporating an external part and a part at depth corresponding to the actual well.

The installation of heating 1 according to the invention thus incorporates a vertical drilled well 2 consolidated by a cylindrical casing 3, which can be a cylindrical metallic pipe. The well, in its extension, is linked to a deep reservoir 12.

This hydrocarbon extraction installation 1 via a well 2 links the surface to an extraction zone in a reservoir 12 located at the well bottom. It comprises the substantially cylindrical casing 3 consolidating said drilling, means 4 to extract the hydrocarbons and means 5 to enable a hot fluid to be circulated in a closed loop from the surface to the section of tubing 7 of the well 2 to be heated then back to the surface.

In the metallic casing 3, tubing 7 is positioned to pump hydrocarbons to the surface and heating tubing 8 and heating tubing 11 are arranged enabling a hot fluid to be circulated from the surface along the section of pumping tubing to be heated.

The extraction means 4 are thus constituted by an extraction unit 6 incorporating the pumping tubing 7 linking this unit to the hydrocarbon reservoir at a deep reservoir level 12 and a well-bottom pump (not shown) for the extraction of the hydrocarbons.

The closed loop circulation means 5 comprise in casing 3 a first thermally insulated heating tubing 8 to inject hot fluid from the surface towards the reservoir. This heating tubing 8 is connected to a unit 9 to continuously heat and inject the hot fluid, for example using a pump 10.

This first heating tubing 8 is surrounded by a second heating tubing 11 to bring back the hot fluid towards the unit 9. The heating tubing 8 and 11 with the hot fluid production unit 9 constitute a continuous flow closed loop for this hot fluid. The hot fluid production unit 9 is constituted by a storage tank or expansion tank 22, a pump 10 and a heater 23 to ensure the continuous flow of the hot fluid in said heating tubing with a continuous control of the temperature and flow rate.

The hot fluid circuit is closed at the distal end of the second tubing 11 by a transversal wall 18 whereas the first tubing 8 is open at its distal end 17. The Figure shows that the distal end 17 opens out in the vicinity of the wall 18 and at a distance from it.

The length of tubing 8 and 11 in casing 3 depends on the zone in which the paraffin builds up against the wall of tubing 7. This zone is generally located at the upper part of the tubing which is the zone in which the hydrocarbons have suffered the most cooling. This zone is generally located from the surface to the depth at which the paraffin deposits appear, which is from 200 to 2,000 metres in depth.

Thus, the hot fluid is injected by the pump 10 in tubing 8 up to its distal end 17, then this hot fluid rises back up to the unit 9 by means of tubing 11. It is thus easy to control the temperature of the hot fluid leaving the heater 23 and the necessary flow of the pump 10.

The Figure also shows that tubing 8 and heating tubing 11 are inserted in their vertical part into the hydrocarbon extraction tubing 7.

FIG. 2 shows a section along AA in FIG. 1 which shows the casing 3. In this casing, there is the extraction tubing 7 surrounding the heating tubing 8 and heating tubing 11. The first tubing 8 is constituted by a first inner pipe 16 surrounded by a second concentric outer pipe 17 and by an insulation 20 arranged in the space between these two pipes.

It goes without saying that the different elements shown in FIGS. 1 and 2 are not drawn to scale and are only shown by way of illustration.

The insulation 20 may be a powder material commonly used in this type of domain. To reinforce the thermal insulation of the tubing 8, the free space or annulus delimited between the two pipes 16 and 17 is subjected to reduced pressure. This reduced pressure can be of between 1 and 100 mbar.

Given that this is a closed flow loop, the hydrocarbons do not become contaminated by the fluid used.

The fact of using a hot fluid has a two-fold effect. The heat prevents the appearance and depositing of solid fractions such as paraffin and asphaltene and also melts the fractions that have already solidified or been deposited during the restarting of a well, for example.

In the case of a heavy oil, the heat acts by maintaining the viscosity of the hydrocarbons as in the reservoir. Thus, for the same pumping power, a greater quantity of liquid will be extracted thereby contributing to an improvement in productivity.

Since the well may reach several hundred metres in depth (100 to 2,000 m), in order for heat to reach the reservoir level, it is essential for highly thermally insulated tubing heat to be used.

Thermally insulated tubing 8 is provided. The tubing 8 is made using the technique known as "pipe-in-pipe". Between the two pipes 16 and 17, insulating material is arranged as described previously.

The first pipe 16 and the inner pipe ensure the circulation of the hot fluid. This pipe 16 is mechanically protected by the second pipe 17, of larger diameter, concentric to the first pipe 16, and thermally by the insulation 20.

There are several possibilities to provide insulation between pipes 16 and 17. It is advantageous to provide crush-resistant insulation 20 that acts as a spacer, either because of its compressive strength or by the regular addition of spacers between the first and second tubing, to prevent the two pipes 16 and 17 from coming into contact with one another. A microporous material may be used as insulation between pipes 16 and 17.

This microporous material, of the type described in patent FR-2746891, is advantageously obtained by compressing a powder, for example fumed silica.

Such a compressed microporous material advantageously has a density of between 180 and 400 kg/m$^3$. The thermal insulating capacities of such a material are significantly improved when it is placed at low pressure in the annulus between the two pipes 16 and 17.

Insulation 20 may also be made by providing a multilayer super-insulation constituted by reflective screens separated by layers of powder, such as described in patent FR-2862122. The screens are constituted by a reflective sheet, for example aluminium, onto which the powder is deposited, coiled in a spiral around itself.

The powder has a granulometry substantially equal to 40 μm, pores whose size is in the order of magnitude of the mean free path of the gas molecules in which this powder is placed and a density of between 50 and 150 kg/m$^3$. The thermal insulating capacities of such a material are significantly improved when it is placed at low pressure, between $10^{-2}$ and 1 mbar, in the annulus between the two pipes 16 and 17.

This insulation, as it does not have sufficient compressive strength properties, requires the addition of spacers regularly positioned between pipes 16 and 17. The material used for these spacers must have good insulating properties. Such a material may advantageously be a microporous material such as that described above.

The heating tubing 8 as described previously with reference to FIGS. 1 and 2 enables sufficient heat to be provided to make the hydrocarbons sufficiently fluid using a boiler of 5 to 500 KW.

The installation 1 according to the invention enables continuous operation to be ensured and avoids the appearance of deposits on the pumping tubing. This enables the crude oil production to be increased by 20 to 100% and avoids any pollution of the reservoirs.

By way of illustration, tubing 8 according to the invention may be constituted by an outer pipe 17 with an outer diameter of 33 mm, a thickness of 2 mm, and an inner pipe 16 with an outer diameter of 13 mm and a thickness of 2 mm and is able to transport 20 kW at 200° C. for an overall distance of 1,000 metres.

Again by way of illustration, tubing 8 constituted by an outer pipe 17 with a diameter of 60 mm and a thickness of 5 mm and an inner pipe 16 with an outer diameter of 33 mm and a thickness of 4 mm will easily transport 200 kW at 200° C. for an overall distance of 2,000 metres.

The length of tubing 8 and tubing 11 depending on the section of the tubing 7 in which the paraffin builds up against the wall. This section is generally located in the upper section of the tubing which is the zone at which the hydrocarbons have been subjected to significant cooling but may also propagate at depth. This section is generally located over a distance of between the surface and a depth of 100 to 2,000 m.

In the case of heavy oil, the length of tubing 8 and tubing 11 may also vary from the surface to the end of the tubing 7 depending on the power that is required to maintain the temperature of the petrol produced.

In the case where there is no well-bottom pump, tubing 8 and tubing 11 may extend beyond the end of tubing 7, in casing 3, in order to have an action on the screen or drain, at the end of casing 3 as well as on the reservoir.

Thus, the hot fluid is injected by the pump 10 in tubing 8 up to its distal end 17, then this hot fluid returns to the unit 9 by means of tubing 11. It is thus easy to control the temperature of the hot fluid and the required flow rate of the pump 10.

In FIGS. 1 and 2, heating tubing 8 and 11 can be seen to be inserted in their vertical part in the hydrocarbon pumping tubing 7.

The invention claimed is:

1. A heating installation for hydrocarbon extraction tubing via a well linking a surface to an extraction zone, comprising:

a cylindrical casing consolidating said well, a hydrocarbon extraction means and a circulation means configured to enable a hot fluid to circulate from the surface to the extraction zone to be heated, wherein:

the circulation means comprise in the cylindrical casing a first thermally insulated heating tubing configured to inject the hot fluid from the surface to a predetermined depth and a second heating tubing surrounding the first thermally insulated heating tubing, the second heating tubing being configured to bring the hot fluid towards the surface, the hydrocarbon extraction means comprise a pumping tubing surrounding the first thermally insulated heating tubing and the second heating tubing for extracting hydrocarbons, the first thermally insulated heating tubing is constituted by a first inner pipe surrounded by a second concentric outer pipe and by an insulation housed in a space between the first inner pipe and the second concentric outer pipe, and the first thermally insulated heating tubing is fitted with an electric heating wire arranged against an inner wall of the first inner pipe.

2. The heating installation according to claim 1, wherein the first thermally insulated heating tubing and the second heating tubing are connected on the surface to a hot fluid production unit that is composed of a storage tank or an expansion tank, a pump and a heater, and is configured to continuously circulate the hot fluid in the first thermally insulated heating tubing and the second heating tubing.

3. The heating installation according to claim 1, wherein the first thermally insulated heating tubing is open at a distal end thereof and the second heating tubing is closed at a distal end thereof by a transversal wall.

4. The heating installation according to claim 1, wherein the first thermally insulated heating tubing is thermally insulated using a compression-resistant insulation.

5. The heating installation according to claim 1, wherein the pumping tubing is connected to a surface extraction unit.

6. The heating installation according to claim 5, wherein the pumping tubing is open at a distal end thereof and equipped with a well-bottom pump.

7. The heating installation according to claim 1, wherein the insulation is constituted by a microporous material and wherein a reduced pressure is established in the space between the first inner pipe and the second concentric outer pipe.

8. The heating installation according to claim 7, wherein the reduced pressure between the first inner pipe and the second concentric outer pipe of the first thermally insulated heating tubing is of between 1 and 100 mbar.

9. The heating installation according to claim 1, wherein the hot fluid is an industrial thermal oil or water.

10. The heating installation according to claim 1, wherein:

the first thermally insulated heating tubing and the second heating tubing form a continuous flow closed circuit such that an open distal end of the first thermally insulated heating tubing faces a closed distal end of the second heating tubing, and the circulation means is configured to deliver the hot fluid through the open distal end of the first thermally insulated heating tubing and into the second heating tubing.

* * * * *